US006668522B2

(12) United States Patent
Prakken

(10) Patent No.: US 6,668,522 B2
(45) Date of Patent: Dec. 30, 2003

(54) METHOD FOR COMPACTING BAGS

(75) Inventor: Martin Prakken, Woerden (NL)

(73) Assignee: BluePrint Holding B.V., Woerden (NL)

( * ) Notice: Subject to any disclaimer, the term of this patent is extended or adjusted under 35 U.S.C. 154(b) by 0 days.

(21) Appl. No.: 10/055,031

(22) Filed: Jan. 25, 2002

(65) Prior Publication Data

US 2003/0140601 A1 Jul. 31, 2003

(51) Int. Cl.[7] ..... B65B 1/22

(52) U.S. Cl. ..... 53/437; 53/433; 53/436; 53/511; 53/525; 53/526; 53/527

(58) Field of Search ..... 53/432, 433, 434, 53/435, 436, 437, 438, 439, 510, 511, 523, 525, 526, 527, 529

(56) References Cited

U.S. PATENT DOCUMENTS

| | | | | | |
|---|---|---|---|---|---|
| 3,381,440 | A | * | 5/1968 | Hullhorst | 53/438 |
| 3,545,983 | A | * | 12/1970 | Woods | 53/433 |
| 4,057,949 | A | * | 11/1977 | Greffe | 53/434 |
| 4,517,790 | A | * | 5/1985 | Kreager | 53/552 |
| 5,170,609 | A | * | 12/1992 | Bullock et al. | 53/434 |
| 5,284,003 | A | * | 2/1994 | Goodman et al. | 53/523 |
| 5,347,793 | A | * | 9/1994 | Cur et al. | 53/526 |
| 5,386,678 | A | * | 2/1995 | Kujubu | 53/512 |
| 5,433,061 | A | * | 7/1995 | Hutchinson et al. | 53/434 |
| 5,493,844 | A | * | 2/1996 | Combrink | 53/434 |
| 5,857,311 | A | * | 1/1999 | Focke et al. | 53/438 |
| 6,094,888 | A | * | 8/2000 | Pazdernik et al. | 53/436 |

FOREIGN PATENT DOCUMENTS

DE 36 09 786 A1 9/1987

* cited by examiner

*Primary Examiner*—John Sipos
*Assistant Examiner*—Louis Huynh
(74) *Attorney, Agent, or Firm*—Young & Thompson

(57) ABSTRACT

Method and device for packing bags filled with product in a box. The bags are made gas-permeable and after the bags have been filled with product the residual volume of gas therein is removed by drawing off the gases present in the bag by means of suction. This is achieved by conveying the bags over a belt on which vacuum is acting. Prior to this step the bags can be subjected to a vibratory treatment in order to optimise the position of the product in the bags.

11 Claims, 2 Drawing Sheets

METHOD FOR COMPACTING BAGS

FIELD OF THE INVENTION

This invention relates to a method and device for packing bags or other flexible containers in an outer packaging, such as boxes. In particular, the invention relates to packing bags, filled with product, in such a way that the volume taken up by the bags in the outer packaging is essentially made up of product.

BACKGROUND TO THE INVENTION

It is generally known in the state of the art to packing products such as deep-frozen French fries in bags. A number of bags are then placed, preferably upright, in an outer packaging, such as a box. A number of boxes are then placed on a pallet and this pallet is transferred from the packing location to a storage location and then to the sales location. Bags of this type are made such that they are permeable to gas.

In practice it has been found that an appreciable quantity of air is present in the bags when these are placed in the outer packaging, such as boxes. When boxes are placed on top of one another the lower boxes have to support the weight of the upper boxes. This support is partly provided by the product present in the boxes. Because the bags are permeable to gas, the load-bearing capacity of such a bag is low because the air gradually escapes from the bags. Consequently it is not possible to keep the boxes effectively in a stack in the longer term if the fill weight is relatively high. Such a high fill weight exists, for example, when the bags are filled with deep-frozen French fries. It must be understood that other products also give this problem.

In order to solve this problem it is proposed in the state of the art to remove air from the bags when closing. For this purpose a pipe or the like is brought close to the product at the open end of the bag before closing and a vacuum is generated during closing. The hose is removed as the final step in closing. Such a method is complex, gives rise to problems with sealing and makes it impossible to work at high speed.

In the prior art it is also proposed to subject the products to a vibratory treatment in order to put these into a bag more compactly. In such a vibratory treatment the bag is held between two plates, at least one of which is vibrating, and the distance between the two plates is then reduced. The volume of the bag is reduced as a result. However, it has been found that damage occurs to the product during this treatment. This applies in particular in the case of elongated products of low breaking strength, such as the French fries described above.

It is known in the prior art to move bags and other products by means of belts, arms and other constructions where vacuum is used to engage the bags or other packagings.

SUMMARY OF THE INVENTION

The invention relates to a method for packing products, comprising introducing said products into a gas-permeable flexible packaging, closing said flexible packaging and placing a number of flexible packagings in an outer packaging, wherein, after closing said flexible packagings and before placing them in said outer packaging, the residual gas volume in said flexible packagings is reduced, wherein said flexible packagings are placed on a support and means generating a vacuum are placed on the gas-permeable part of said flexible packagings in order to reduce the volume of said flexible packagings.

The means generating a vacuum can be applied both to the top of the flexible packaging and to the underside of the flexible packaging.

According to a particular aspect of the invention, vacuum for reducing the volume of said flexible packaging is generated by said support.

According to the invention the vacuum is not used for handling the flexible packaging but for removing air or other gases therefrom after the bags have been closed. Such removal of gases can take place within a relatively short time, it always being ensured that no damage occurs to the product. The flexible packaging can then be placed in an outer packaging and stacking of the outer packaging can take place without any risk.

According to a further aspect of the present invention, before the vacuum is applied a first portion of the gas present in the flexible packaging is removed by subjecting the flexible packaging to a vibratory treatment between two vibrating plates. In contrast to the prior art, it is not necessary to drive out the desired volume solely by means of this vibratory treatment, so that the risk of damage to the product present in the flexible packagings is appreciably reduced.

According to a further aspect of the present invention, vacuum is applied via a support and this support is movable and, for example, constructed as a conveyor belt. By this means vacuum can be applied for a relatively long time without delaying the production process. If a relatively short belt is used, this support can be movable in an indexing manner.

According to a further aspect the invention relates to a device for packing products, comprising a feed for products, a feed for gas-permeable film material, means for producing bags from said film material, filling means for introducing products from said feed into said bags, closing and separating means for closing and separating said bags, vibratory means for reducing the volume of said closed bags, vacuum-generating means for applying vacuum to said film material in order to reduce the volume of said closed bags, and placing means for placing a number of bags in an outer packaging.

The above aims, characteristics and advantages of the invention, and further aims, characteristics and advantages of the invention, will be described in more detail in the following description with reference to the appended drawing in which an illustrative embodiment of the present invention is given.

DETAILED DESCRIPTION OF THE INVENTION

Figure 1:
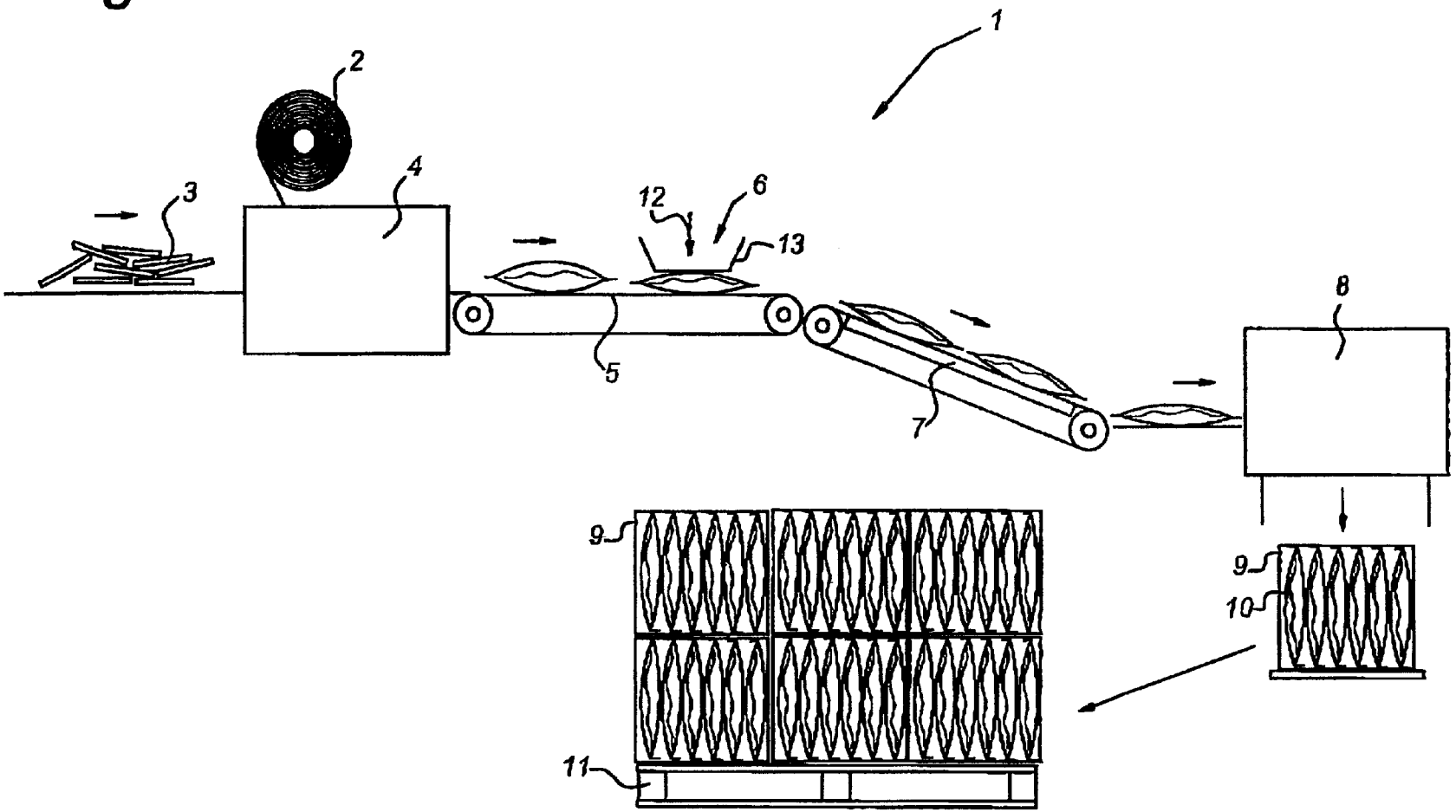
FIG. 1 is a diagrammatic view of a packaging installation according to the invention.

In FIG. 1 a device for packaging product is indicated in its entirety by 1. The product to be packed, such as long thin French fries, is indicated by 3, whilst the bags in which these are packed are made from film material. A web of film material is indicated by 2. Both the web of film 2 and the products 3 are fed to a packing station 4, at which bags are produced and filled with a product in a manner not shown in more detail. In this context it is possible for the film material 2 to be present in the form of a tube, but this material can also be present in the form of a web that is folded in the packing station to give a tube and is provided with ends.

The film material used and/or the end closures are made to be permeable to gas.

The bags are then placed on a buffer conveyor 5. 6 indicates a vibratory device where the upper vibrating plate 13 can be moved in the direction of arrow 12 towards the buffer conveyor 5. Whilst already vibrating, the product 3 is taken up in the flexible bag in the most compact manner and any remaining gas is largely removed. However, the pressure applied during this operation is not so great that there is a risk of breakage of the product.

The bags then pass onto a vacuum conveyor 7, the details of which will be given with reference to FIG. 2. The bags then pass into a packing station 8. In this packing station 8 the bags are gathered together in some way or other known in the state of the art and placed in an outer packaging such as a box 9. The bags are accommodated in the vertical position in the box 9 and are indicated by 10. A number of boxes 9 are then stacked on a pallet 11 and dispatched. In other embodiments the bags can be packed horizontally.

If the weight of the products that are packed is relatively high, the strength of the boxes on their own is not sufficient to support the weight of the boxes above them. In such a case the product present in the boxes must contribute to transfer of the weight from the higher boxes to the pallet. For this purpose it is important that the tops of the flexible packaging are made such that they contribute to the support, that is to say extend up to very close to the top surface of the boxes 9. In the case of perforated bags it is important that the products are so compacted and the bags are further emptied to such an extent that the load-bearing capacity of the flexible bag concerned is not lost as a result of the subsequent escape of air or other gas. This problem is avoided by use of the vacuum belt according to the invention.

Figure 2:
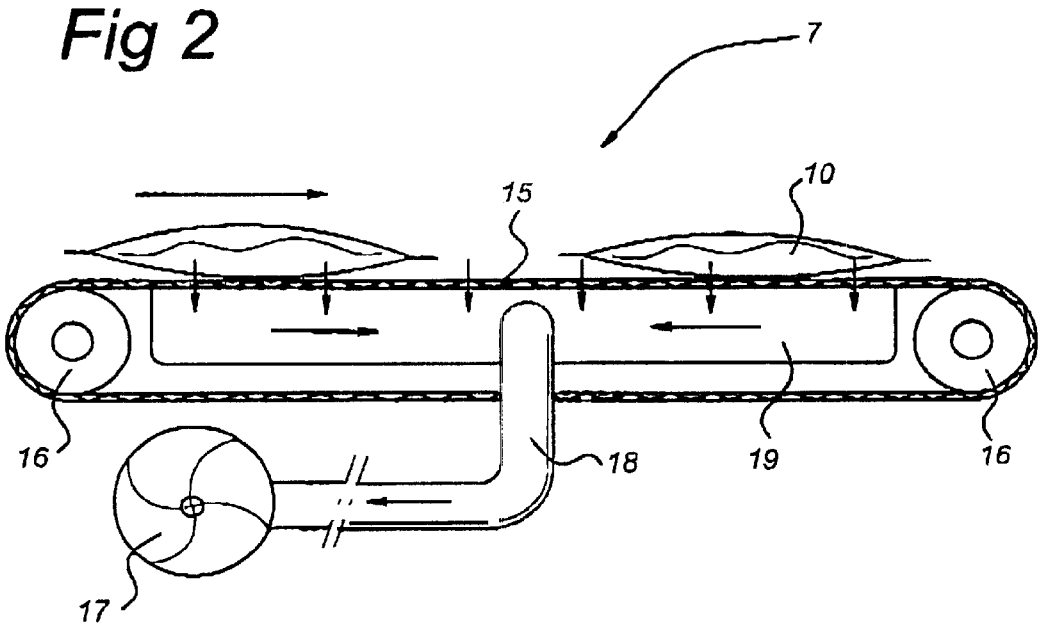
FIG. 2 shows a detail of the device according to FIG. 1.
Figure 3:
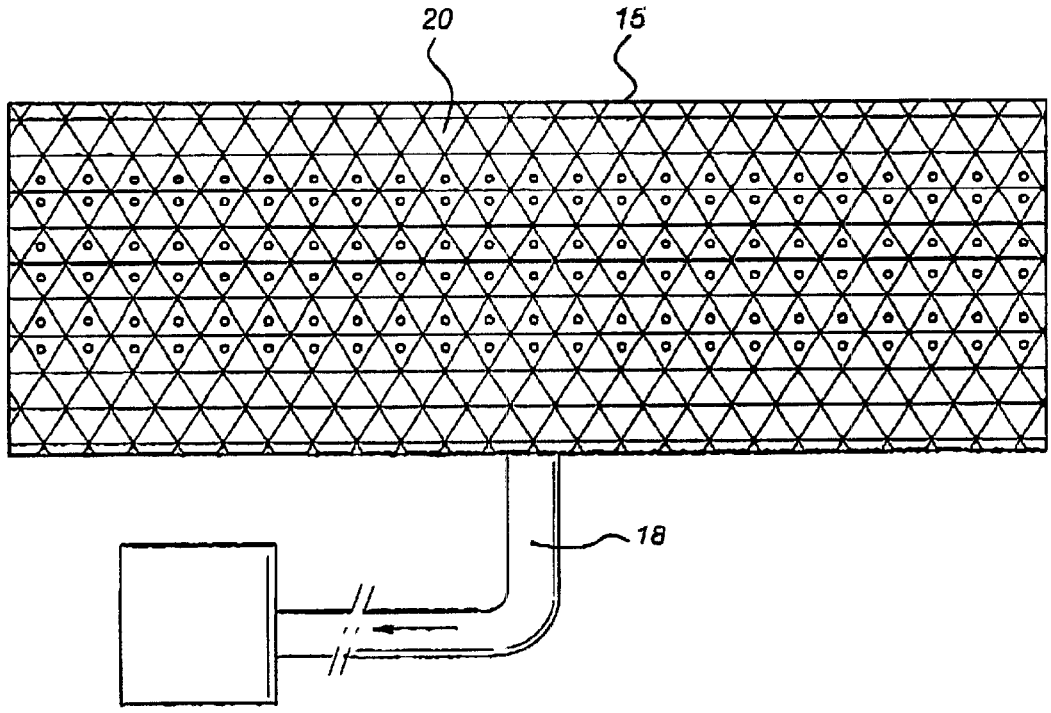
FIG. 3 is a plan view of the support according to the invention.

It can be seen from FIG. 2 that such a vacuum belt comprises a support 15 that runs over two rollers 16. There is a stationary channel-like construction 19 that is connected to a vacuum source 17 via a line 18. Since the vacuum generated does not have to be too high, a simple centrifugal ventilator can suffice. The support 15 can be seen in plan view in FIG. 3. This support is provided with diamond-shaped recesses via which the vacuum is transferred to the bags. As the bags 10 are moved by the conveyor 7 any air or other gas still present in the bags is drawn off. If large quantities of air have to be removed it is possible to execute the movement of support 15 in an indexing manner, that is to say the porous parts of the bags 10 are above channel 19 for some time.

By working in this way, optionally in combination with vibratory device 6, it is possible to adapt the bags to the shape of the product contained therein. By this means the load-bearing capacity of the flexible packaging in the outer packing 9 can be optimised and a number of boxes can be stacked on a pallet without the risk of boxes subsequently settling at an angle.

Although the invention has been described above with reference to a preferred embodiment, it must be understood that numerous modifications can be made which fall within the scope of the appended claims. For instance, it is possible to apply individual vacuum-generating means, such as vacuum cups and the like, to the top of the bag at the location of the openings therein and to reduce the volume of the bag from the top.

What is claimed is:

1. A method for packing products, comprising the steps of:

forming a plurality of gas-permeable flexible packagings from a gas-permeable film material;

introducing products into each of said gas-permeable flexible packagings;

closing said filled flexible packagings to completely enclose the products within the packagings;

placing a number of closed and filled flexible packagings in an outer packaging; and after closing said filled flexible packagings and before placing said closed and filled flexible packagings in said outer packaging, the step of:

said closed and filled flexible packagings by placing a wall portion of said closed and filled flexible packagings supported on an upper surface of a support and applying a vacuum through said upper surface to said closed and filled flexible packagings through said wall portion supported on said upper surface of said support to withdraw gas through said gas-permeable film material of said closed and filled flexible packagings, there being no further closing of said filled flexible packagings between the step of reducing volume and the step of placing the packagings in the outer packaging.

2. The method according to claim 1, further comprising subjecting the closed and filled flexible packagings to a vibratory treatment before placing on said support.

3. The method according to claim 1, wherein, said products are deep-frozen products and maintaining a reduced temperature during packing.

4. The method according to claim 1, wherein said support is movable.

5. The method according to claim 4, wherein said support is movable in an indexing manner.

6. The method according to claim 1, wherein said products are French fries.

7. The method according to claim 1, wherein said outer packaging is a box and said closed and filled flexible packagings are rectangular and are arranged in said box with the long side upright.

8. The method according to claim 7, further comprising stacking a number of boxes on top of one another.

9. A device for packing products, comprising:

a feed for products;

a feed for gas-permeable film material;

means for producing bags from said film material positioned adjacent the feed for gas-permeable film material;

filling means for introducing products from said feed for products into said bags, the filling means being positioned at an outlet of the feed for products;

closing and separating means for completely closing and separating said filled bags positioned in communication with the filling means;

vibratory means for shaping of said closed and filled bags positioned in communication with the closing and separating means;

positioned downstream of the vibratory means, vacuum-generating means with an upper surface for supporting thereupon a gas-permeable wall of said closed and filled bags and for applying vacuum to the supported gas-permeable wall of said closed and filled bags for reducing the volume of said closed and filled bags by withdrawing gas through the gas-permeable film wall of said closed and filled bags supported atop the upper surface of the vacuum-generating means; and placing means for placing a number of said closed and filled bags in an outer packaging, the placing means being adjacent said vacuum-generating means so that placing the closed and filled bags in the outer packaging follows immediately after withdrawing gas from the bags.

10. The device according to claim 9, wherein said vacuum means comprise a conveyor belt including a conveying surface provided with recesses connected to a vacuum source.

11. The device according to claim 10, wherein said conveyor belt is an indexing conveyor belt.

* * * * *